US009196210B2

(12) United States Patent
Chang et al.

(10) Patent No.: US 9,196,210 B2
(45) Date of Patent: Nov. 24, 2015

(54) DRIVING MODULE AND DRIVING METHOD FOR AVOIDING CHARGING INEQUALITY

(75) Inventors: Yu-Pin Chang, Hsinchu County (TW); Chih-Peng Hsia, Hsinchu County (TW); Tsung-Yin Yu, Yilan County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 322 days.

(21) Appl. No.: 12/797,609

(22) Filed: Jun. 10, 2010

(65) Prior Publication Data

US 2011/0279443 A1 Nov. 17, 2011

(30) Foreign Application Priority Data

May 13, 2010 (TW) ..... 99115290 A

(51) Int. Cl.
*G09G 3/36* (2006.01)

(52) U.S. Cl.
CPC ..... *G09G 3/3688* (2013.01); *G09G 3/3614* (2013.01); *G09G 2310/0251* (2013.01); *G09G 2310/0283* (2013.01); *G09G 2320/0233* (2013.01); *G09G 2320/0242* (2013.01)

(58) Field of Classification Search
CPC ..... G09G 3/3688; G09G 3/3614; G09G 2320/0242; G09G 2310/0283; G09G 2310/0251
See application file for complete search history.

(56) References Cited

U.S. PATENT DOCUMENTS

| | | | | |
|---|---|---|---|---|
| 6,184,853 | B1 * | 2/2001 | Hebiguchi et al. | 345/88 |
| 6,744,216 | B2 * | 6/2004 | Saito et al. | 315/169.3 |
| 6,894,667 | B1 * | 5/2005 | Lin | 345/87 |
| 6,943,781 | B1 * | 9/2005 | Lin et al. | 345/204 |
| 7,557,791 | B2 * | 7/2009 | Tokumura | 345/98 |
| 2007/0120810 | A1 * | 5/2007 | You et al. | 345/103 |
| 2009/0179875 | A1 * | 7/2009 | Li et al. | 345/204 |
| 2010/0013864 | A1 * | 1/2010 | Oelhafen et al. | 345/690 |
| 2010/0123647 | A1 * | 5/2010 | Goo et al. | 345/55 |
| 2010/0182333 | A1 * | 7/2010 | Chiang | 345/589 |

FOREIGN PATENT DOCUMENTS

| | | |
|---|---|---|
| CN | 101620841 A | 1/2010 |
| TW | 200634711 | 10/2006 |
| TW | 200743088 | 11/2007 |
| TW | 200933576 | 8/2009 |
| TW | 201005722 | 2/2010 |
| TW | 201011720 | 3/2010 |

* cited by examiner

*Primary Examiner* — Aneeta Yodichkas
*Assistant Examiner* — Joseph Fox
(74) *Attorney, Agent, or Firm* — Winston Hsu; Scott Margo

(57) ABSTRACT

The present invention discloses a driving module for a liquid crystal display device. The driving module includes a data line signal processing unit, for generating a plurality of data driving signals, a scan line signal processing unit, for generating a plurality of gate driving signals, and a control unit, for controlling the data line signal processing unit and the gate line signal processing unit, such that a plurality of sub-pixels corresponding to a data line are with different charging orders in different frames, or are charged with different charging periods in a same frame.

2 Claims, 12 Drawing Sheets

DRIVING MODULE AND DRIVING METHOD FOR AVOIDING CHARGING INEQUALITY

BACKGROUND OF THE INVENTION

1. Field of the Invention

The present invention relates to a driving module and driving method, and more particularly, to a driving module and driving method charging subpixels with different charging orders in different frames, or charging subpixels with different charging periods in a same frame, to avoid charging inequality among the subpixels.

2. Description of the Prior Art

A liquid crystal display (LCD) device utilizes a source driver and a gate driver to drive pixels on a panel to display images. Since cost of a source driver is higher than that of a gate driver, in order to reduce number of source drivers, a pixel structure evolves from a single gate structure to a dual gate structure or a tri-gate structure. Taking the tri-gate structure as an example, for the same number of pixels, compared to the single gate structure, the tri-gate structure only has one-third as many data lines, and thrice as many scan lines for reducing the cost. However, since a gate driving signal has only a third of the conventional active cycle, a data line can only charge pixels with a third of the conventional charging time, and the pixels are likely charged insufficiently.

Please refer to FIG. 1, which is a schematic diagram of an LCD device 10 with a stripe tri-gate pixel structure in the prior art. For clear illustration, the LCD device 10 only includes a source driver 100, a gate driver 102, a timing controller 104, an LCD panel 106, data lines S1-Sm, scan lines G1-Gn and a pixel matrix Mat_S. The timing controller 104 utilizes a horizontal synchronization signal Hsync and an output enable signal Ena to control the source driver 100 and the gate driver 102, respectively, to generate data driving signals Sig_S1-Sig_Sm and gate driving signals Sig_G1-Sig_Gn, so as to charge the pixel matrix Mat_S. In the pixel matrix Mat_S, each pixel includes a red subpixel R, a green subpixel G and a blue subpixel B, and each subpixel includes a transistor and a capacitor, which are denoted by blocks for simplicity. In one cycle of the horizontal synchronization signal Hsync, the data driving signals Sig_S1-Sig_Sm charge a corresponding pixel, respectively. For example, in one cycle of the horizontal synchronization signal Hsync, the data driving signal Sig_S1 charges a pixel corresponding to the data line S1 and the scan lines G1-G3, i.e. a red subpixel, a green subpixel and a blue subpixel. Under such a situation, since charging period for a subpixel in the tri-gate structure is only a third of that of the single gate structure, the subpixels are likely charged insufficiently.

Please refer to FIG. 2, which is a schematic diagram of the LCD device 10 driving subpixels corresponding to the data line S1 in frames F1, F2. FIG. 2 indicates charging orders of the scan lines G1-Gn and corresponding subpixels thereof, and a waveform of the data driving signal Sig_S1 in horizontal synchronization cycles Hsync_C1, Hsync_C2. As shown in FIG. 2, since the data driving signal Sig_S1 has circuit RC delay, the data driving signal Sig_S1 needs a period to reach a settled state when the data driving signal Sig_S1 has polarity change. Besides, subpixels within the same horizontal synchronization cycle have the same charging period. As a result, for subpixels corresponding to the same horizontal synchronization cycle, a subpixel with the most prior charging order of the data driving signal Sig_S1 is charged insufficiently. For example, in the frame F1, the charging orders are scan lines G1→G2→G3 and subpixels R→G→B in the horizontal synchronization cycle Hsync_C1. Since the data driving signal Sig_S1 does not reach the settled state when charging the red subpixel R, the red subpixel R is charged less sufficiently compared to the green subpixel G and the blue subpixel B. Similarly, in the frame F2, since the red subpixel R is still the subpixel with the most prior charging order of the data driving signal Sig_S1 in the horizontal synchronization cycle Hsync_C1, the red subpixel R is still charged less sufficiently. By the same token, the red subpixels R corresponding to the scan line G1 and the data lines S1-Sm are all charged less sufficiently, causing the LCD device 10 to exhibit light and dark lines and color inequality due to charging inequality among subpixels.

Please refer to FIG. 3A and FIG. 3B, which are schematic diagrams of utilizing double gate pulses and overlap gate pulse to drive subpixels in the prior art, respectively. In order to eliminate charging inequality, the prior art utilizes the double gate pulses or the overlap gate pulse to pre-charge the subpixels, such that the subpixels are not charged unequally when the data driving signals charge the subpixels. As shown in FIG. 3A, compared to the driving method shown in FIG. 2, the double gate pulses pre-charges the subpixels before the horizontal synchronization cycle Hsync_D1, Hsync_D2, such that the LCD device 10 does not have light and dark lines and color inequality due to charging inequality among subpixels in the horizontal synchronization cycle Hsync_C1, Hsync_C2. Similarly, as shown in FIG. 3B, the overlap gate pulse pre-charges the subpixels before a third of the horizontal synchronization cycle Hsync_C1, i.e. charging period for a subpixel, such that the LCD device 10 does not have light and dark lines and color inequality due to charging inequality among subpixels in the horizontal synchronization cycle Hsync_C1, Hsync_C2.

However, driving methods of the double gate pulses and the overlap gate pulse in the prior art need extra pulses to avoid charging inequality, which increase power consumption and inconvenience. Thus, there is a need for improvement.

SUMMARY OF THE INVENTION

It is therefore an objective of the present invention to provide a driving module and driving method.

The present invention discloses a driving module for a liquid crystal display device. The driving module includes a data line signal processing unit, for generating a plurality of data driving signals, a scan line signal processing unit, for generating a plurality of gate driving signals, and a control unit, for controlling the data line signal processing unit and the scan line signal processing unit, to charge a plurality of subpixels corresponding to a data line with different charging orders in different frames.

The present invention further discloses a driving method for liquid crystal display device. The driving method includes the steps of providing a plurality of data driving signals, and providing a plurality of gate driving signals, and charging a plurality of subpixels corresponding to a data line with different charging orders indifferent frames according to the plurality of data driving signals and the plurality of gate driving signals.

The present invention further discloses a driving module for a liquid crystal display device. The driving module includes a data line signal processing unit, for generating a plurality of data driving signals, a scan line signal processing unit, for generating a plurality of gate driving signals, and a control unit, for controlling the data line signal processing unit and the scan line signal processing unit, to charge a plurality of subpixels corresponding to a data line and a horizontal synchronization cycle with different charging periods in a same frame.

The present invention further discloses a driving method for liquid crystal display device. The driving method including the steps of providing a plurality of data driving signals, and providing a plurality of gate driving signals, and charging a plurality of subpixels corresponding to a data line and a horizontal synchronization cycle with different charging periods in a same frame according to the plurality of data driving signals and the plurality of gate driving signals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
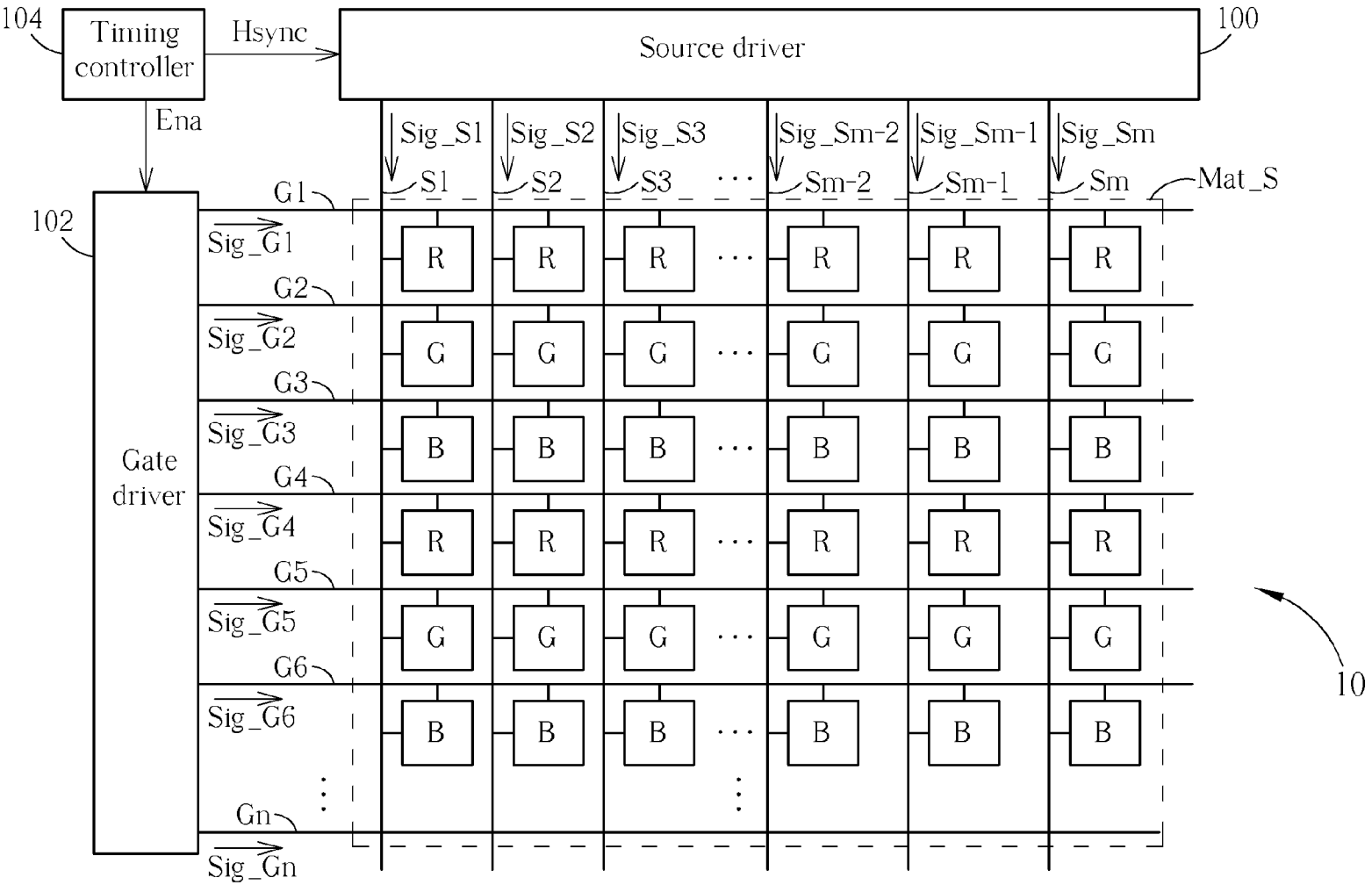
FIG. 1 PRIOR ART
FIG. 1 is a schematic diagram of a LCD device with a stripe tri-gate pixel structure in the prior art.
Figure 2:
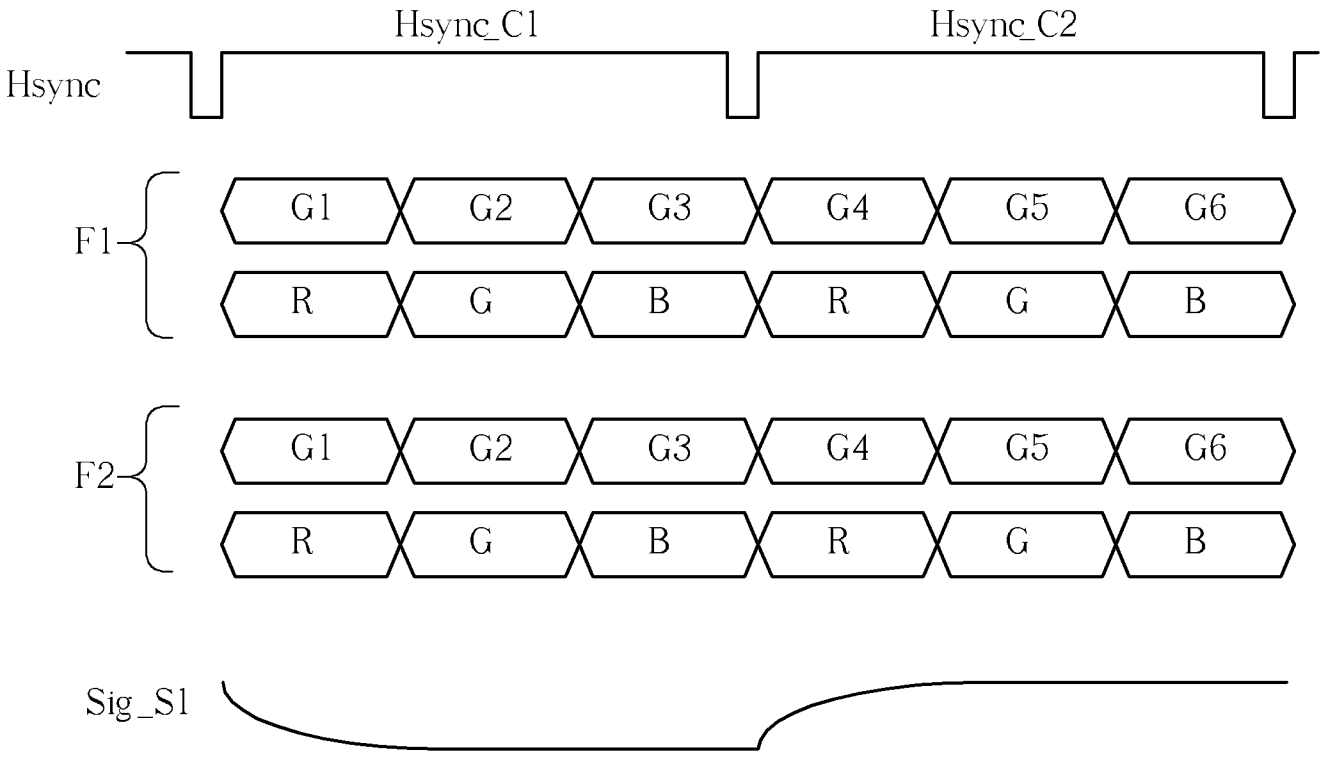
FIG. 2 PRIOR ART
FIG. 2 is a schematic diagram of the LCD device driving subpixels corresponding to a data line in frames.
Figure 3A:
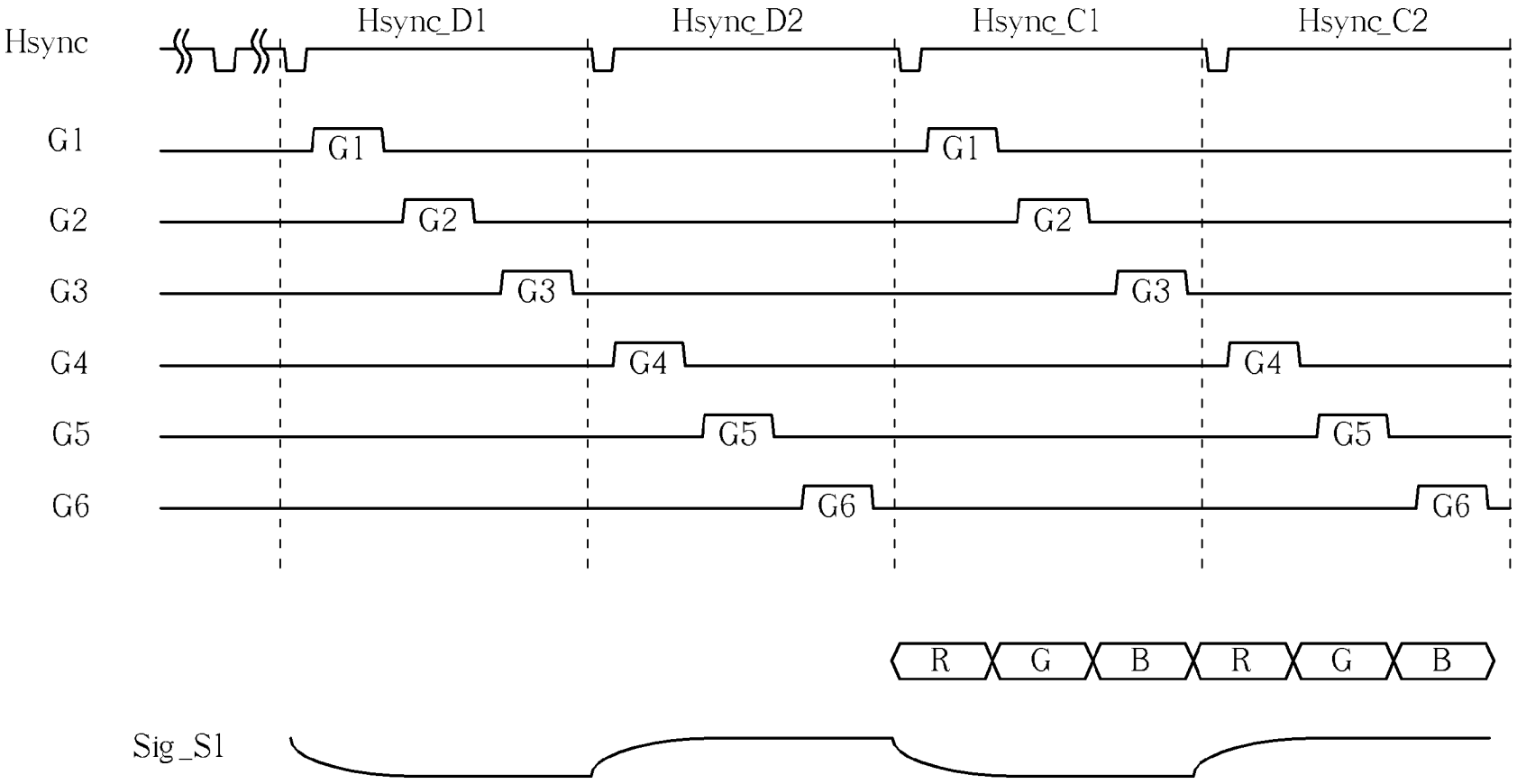
FIG. 3A PRIOR ART
FIG. 3A and FIG. 3B are schematic diagrams of utilizing double gate pulses and overlap gate pulse to drive subpixels in the prior art, respectively.
Figure 3B:
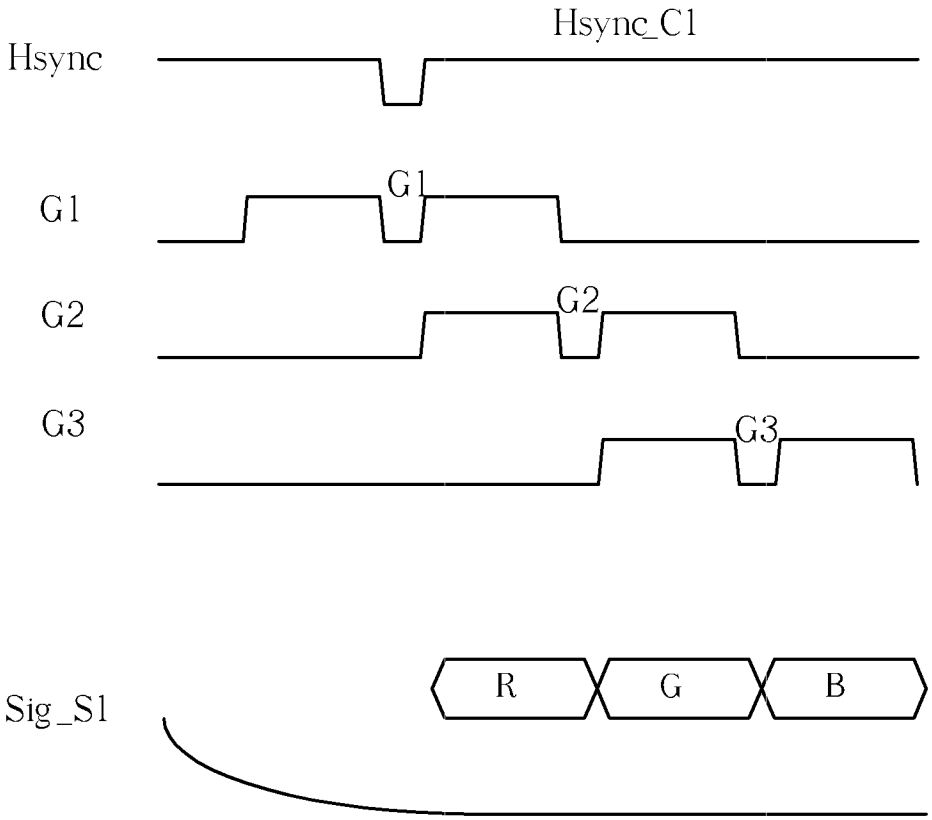
FIG. 3B PRIOR ART
Figure 4:
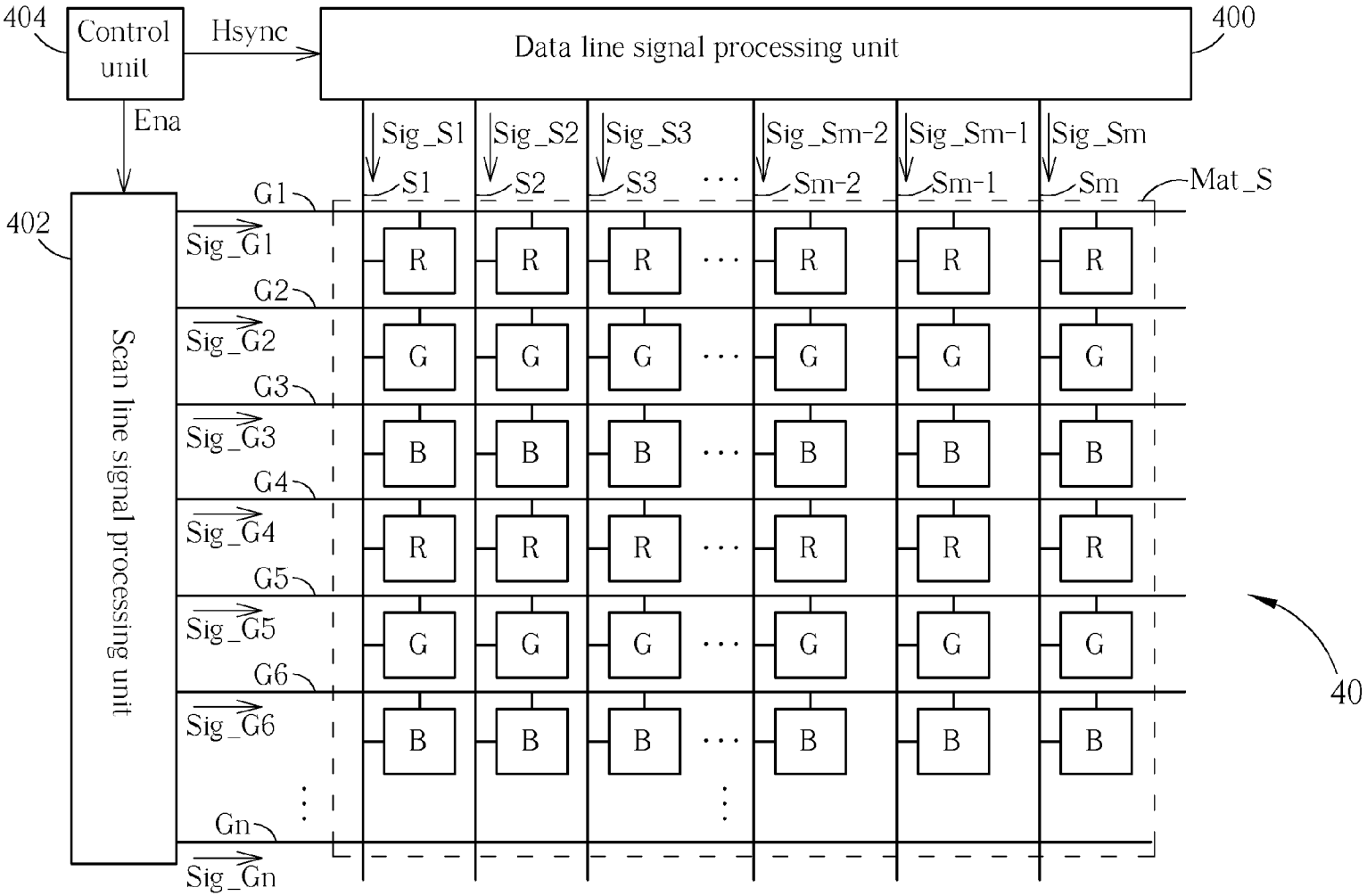
FIG. 4 is a schematic diagram of a driving module according to an embodiment of the present invention.

Please refer to FIG. 4, which is a schematic diagram of a driving module 40 according to an embodiment of the present invention. For clear illustration, elements with the same function and structure of those shown in FIG. 1 are denoted by the same figures and symbols in FIG. 1. The driving module 40 drives the pixel matrix Mat_S via the data lines S1-Sm and the scan line G1-Gn, to avoid charging inequality. The driving module 40 includes a data line signal processing unit 400, a scan line signal processing unit 402 and a control unit 404. The control unit 404 generates the horizontal synchronization signal Hsync and the output enable signal Ena, to control the data line signal processing unit 400 and the scan line signal processing unit 402, so as to output the data driving signals Sig_S1-Sig_Sm to the data lines S1-Sm, and output the gate driving signals Sig_G1-Sig_Gn to the scan lines G1-Gn. In order to avoid charging inequality, the control unit 404 controls the data line signal processing unit 400 and the scan line signal processing unit 402, to charge subpixels corresponding to the same data line with different charging orders indifferent frames, or to charge subpixels corresponding to the same data line and the same horizontal synchronization cycle with different charging periods in a same frame.

In short, the present invention adjusts the data driving signals Data_1-Data_p and the gate driving signals Gate_1-Gate_q, to charge subpixels corresponding to the same data line with different charging orders in different frames, or to charge subpixels corresponding to the same data line and the same horizontal synchronization cycle with different charging periods in a same frame.

Figure 5A:
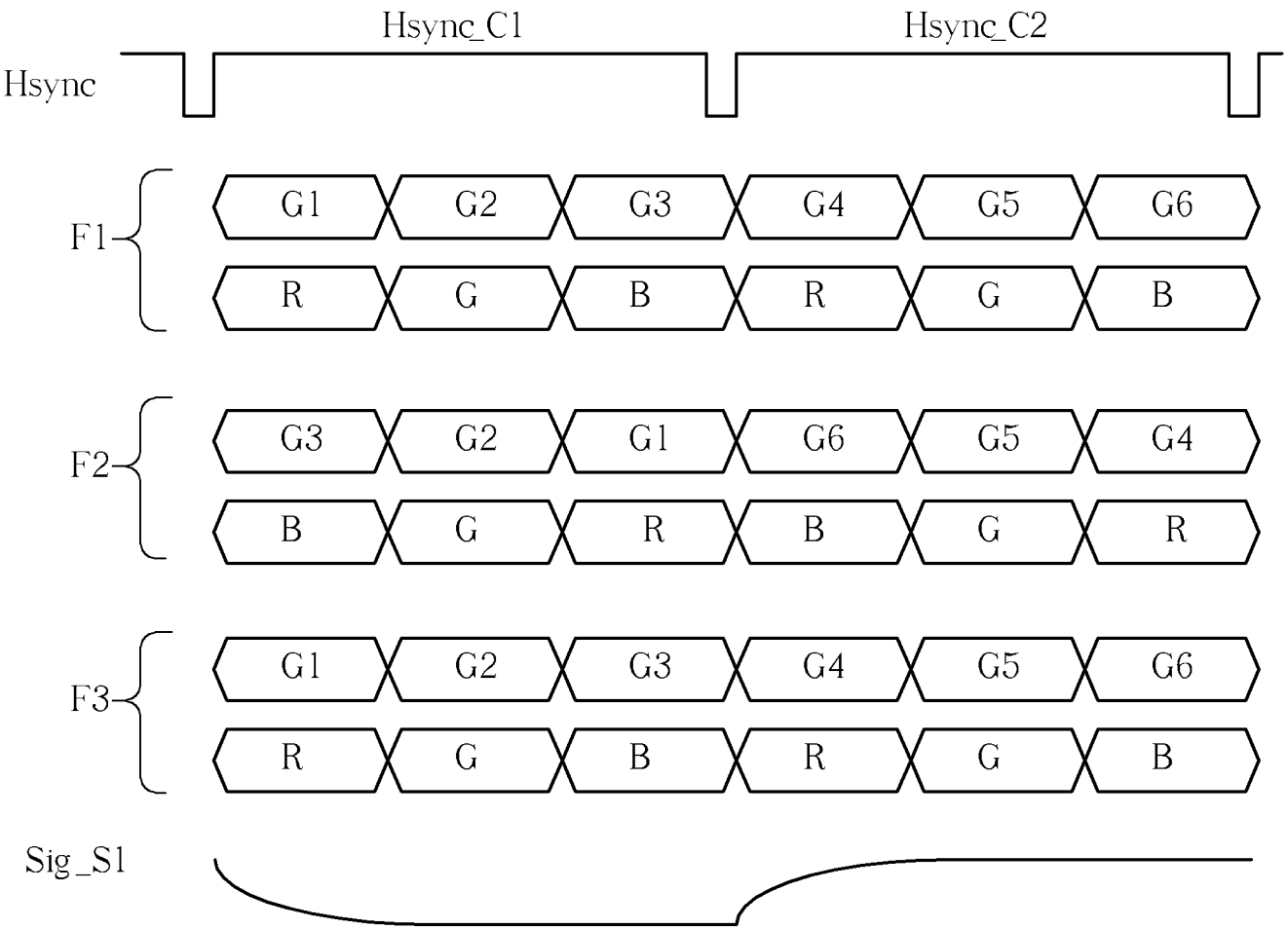
FIG. 5A to FIG. 5C are schematic diagrams of the driving module of FIG. 4 charging subpixels with different charging orders in different frames.
Figure 5B:
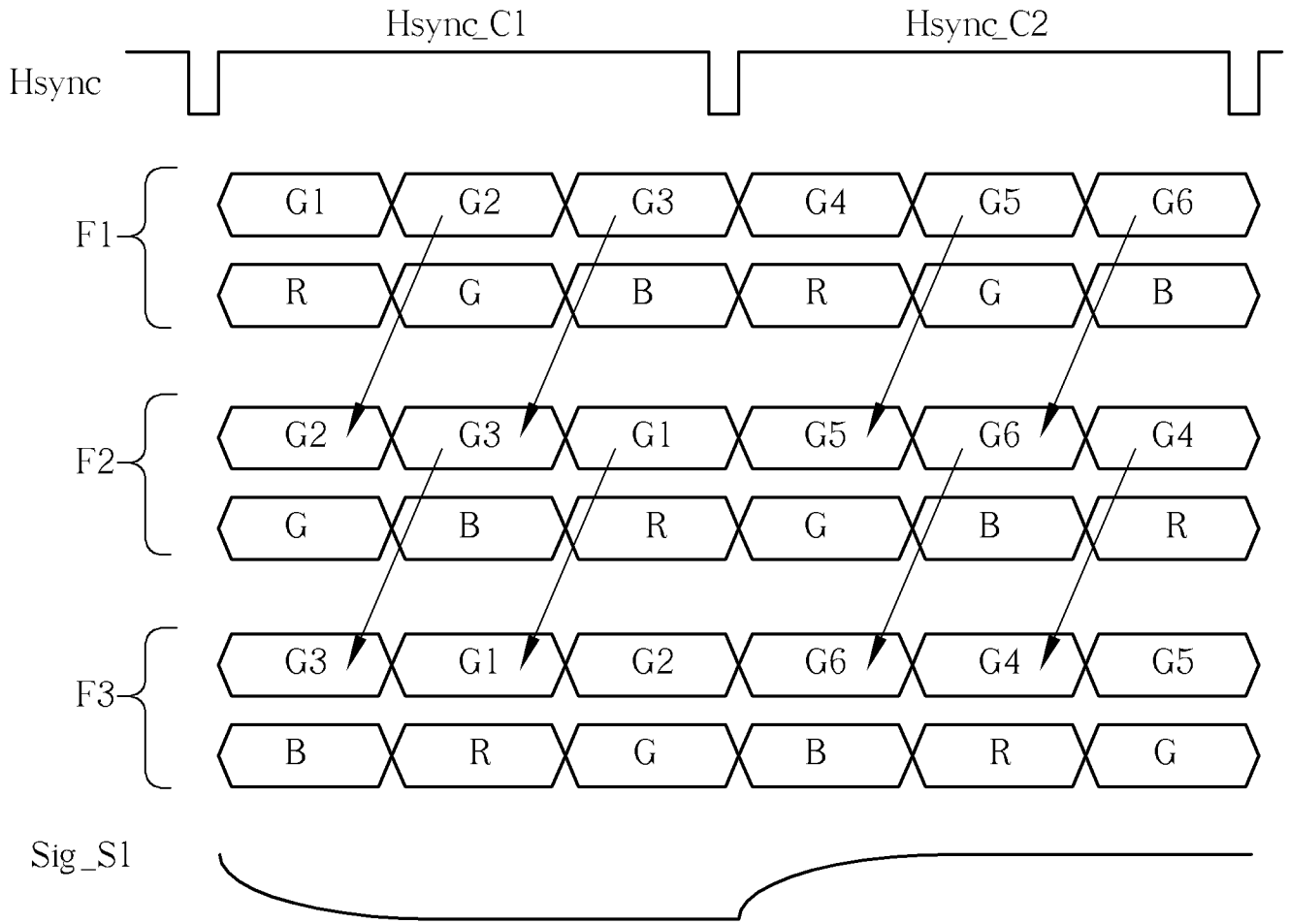
Figure 5C:
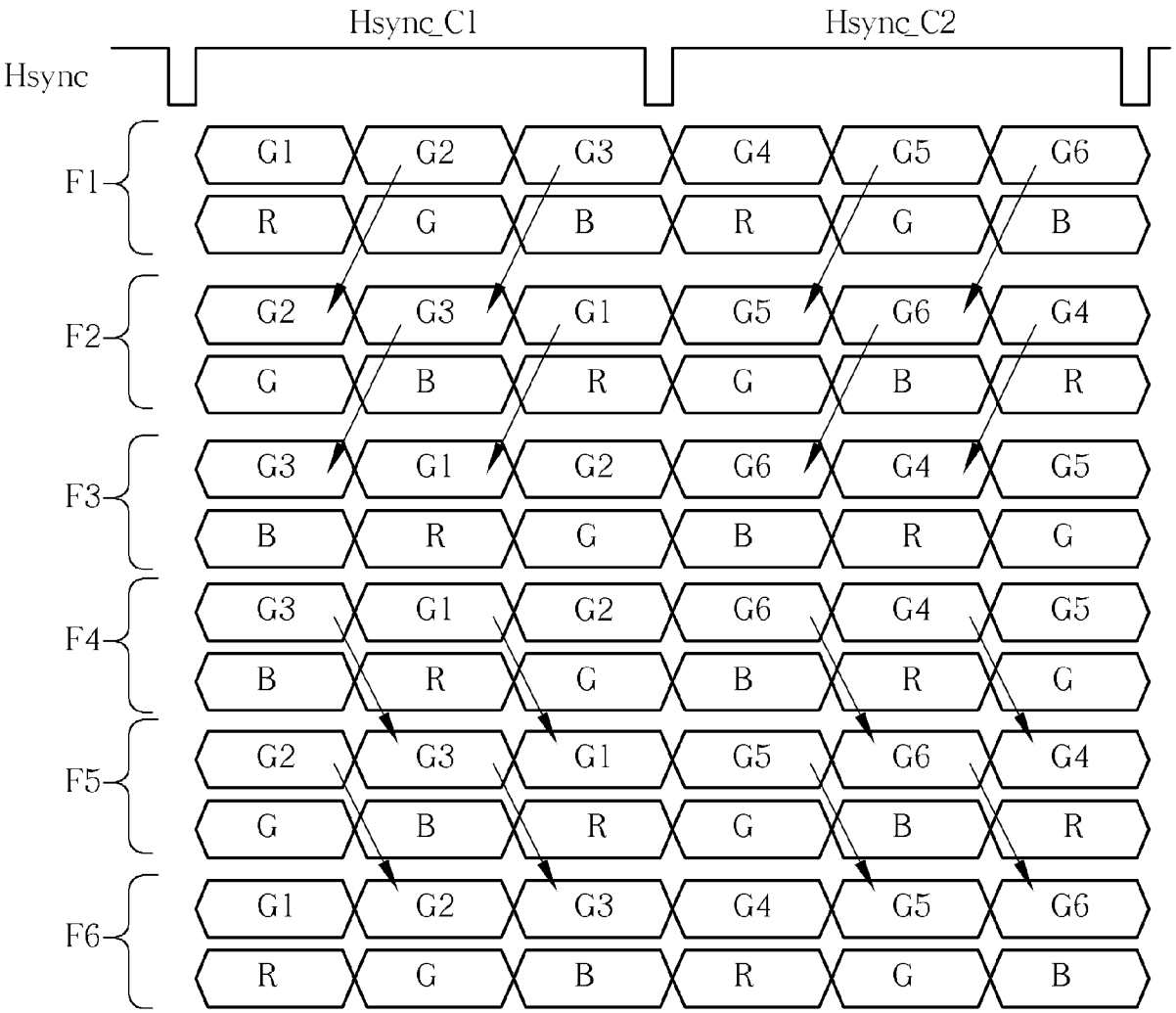

For example, please refer to FIG. 5A to FIG. 5C, which are schematic diagrams of the driving module 40 of FIG. 4 charging subpixels with different charging orders indifferent frames. As shown in FIG. 5A, the driving module 40 utilizes the corresponding data driving signals to charge subpixels with reverse charging orders in two adjacent frames. In detail, in the frame F1, a charge charging order of the horizontal synchronization cycle Hsync_C1 is scan lines G1→G2→G3 and subpixels R→G→B, and in the frame F2, the data driving signal Sig_S1 charges subpixels with a reverse charging order of that of the frame F1, i.e. a charge charging order in the horizontal synchronization cycle Hsync_C1 is scan lines G3→G2→G1 and subpixels B→G→R, and in the frame F3, the data driving signal Sig_S1 charges subpixels with a reverse charging order of that of the frame F2, i.e. a charge charging order in the horizontal synchronization cycle Hsync_C1 is scan lines G1→G2→G3 and subpixels R→G→B. As a result, the red subpixels R and the blue subpixels B are subpixels charged less sufficiently in turn, which can prevent light and dark lines and color inequality due to charging inequality among subpixels.

Similarly, as shown in FIG. 5B, the driving module 40 utilizes the corresponding data driving signals to sequentially charge each subpixel with a most prior charging order in adjacent frames according to a charging priority. In detail, in the frame F1, the data driving signal Sig_S1 charges the red subpixel R with the most prior charging order, i.e. a charge charging order of the horizontal synchronization cycle Hsync_C1 is scan lines G1→G2→G3 and subpixels R→G→B, and in the frame F2, the data driving signal Sig_S1 charges the green subpixel G with the most prior charging order, i.e. a charge charging order of the horizontal synchronization cycle Hsync_C1 is scan lines G2→G3→G1 and subpixels G→B→R, and in the frame F3, the data driving signal Sig_S1 charges the blue subpixel B with the most prior charging order, i.e. a charge charging order of the horizontal synchronization cycle Hsync_C1 is scan lines G3→G1→G2 and subpixels B→R→G. In other words, the data driving signal Sig_S1 charges the subpixels with a charging order of subpixels R→G→B as the charging priority. As a result, the red subpixel R, the green subpixel G and the blue subpixel B are subpixels charged less sufficiently in turn, which can prevent light and dark lines and color inequality due to charging inequality among subpixels.

As shown in FIG. 5C, after the driving module 40 utilizes the corresponding data driving signals to sequentially charge each subpixel with the most prior charging order, the driving module 40 can further utilize the data driving signals to sequentially charge each subpixel with the most prior charging order according to a reverse charging order of the charging priority. In detail, difference between operations of FIG. 5C and FIG. 5B is: after the data driving signal Sig_S1 charges subpixels with a charging order of subpixels R→G→B as the charging priority, the data driving signal Sig_S1 charges subpixels with a charging order of subpixels B→G→R as the charging priority in frames F4-F6, i.e. the data driving signal Sig_S1 charges subpixels with a charging order of subpixels R→G→B→B→G→R as the charging priority. As a result, other than the red subpixel R, the green subpixel G and the blue subpixel B are subpixels charged less sufficiently in turn, subpixels are more equally charged insufficiently, to prevent light and dark lines and color inequality due to charging inequality among subpixels.

Figure 6:
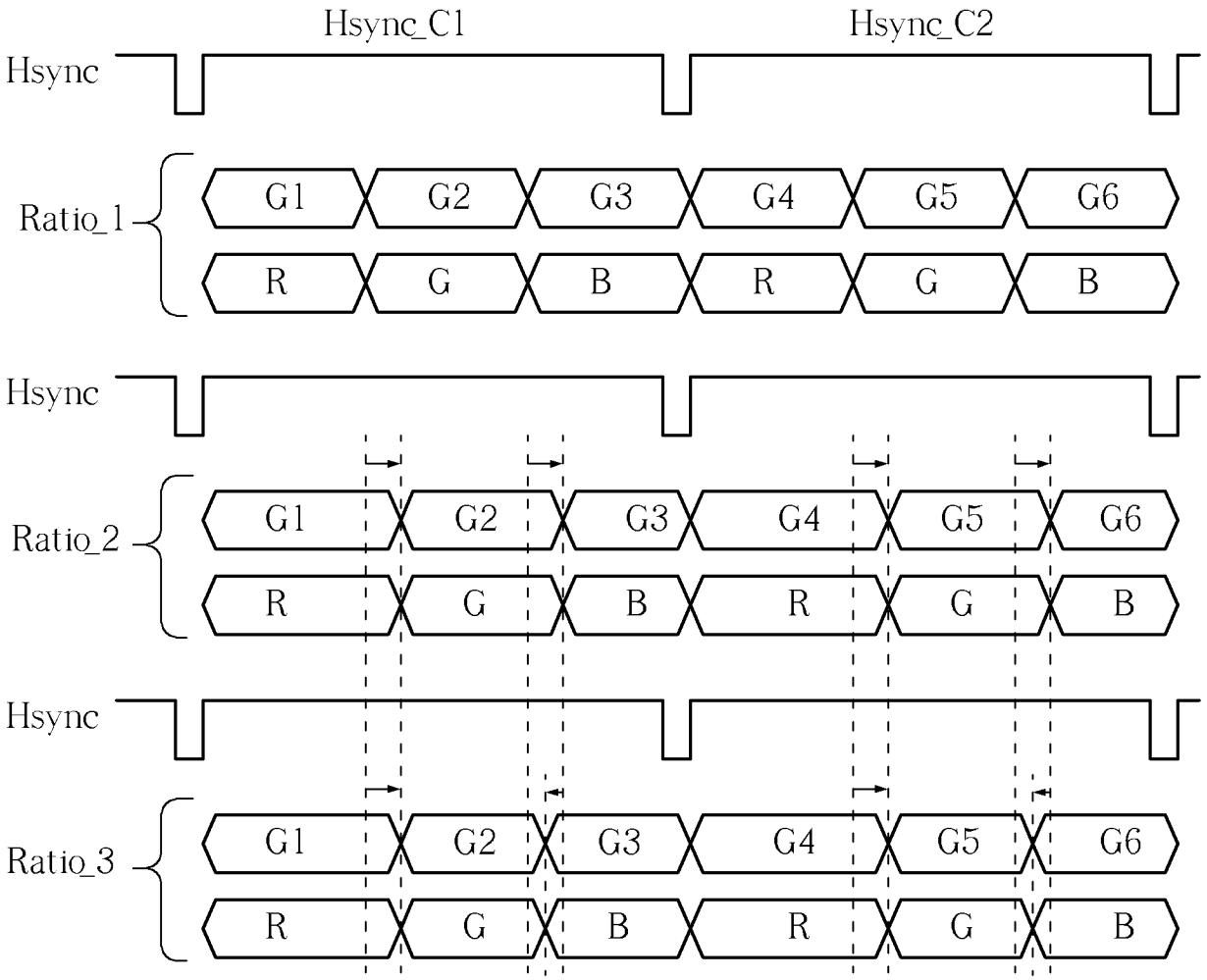
FIG. 6 is a schematic diagram of the driving module of FIG. 4 charging subpixels with different charging period in the same frame.

On the other hand, please refer to FIG. 6, which is a schematic diagram of the driving module 40 of FIG. 4 charging subpixels with different charging periods in the same frame. As shown in FIG. 6, the driving module 40 utilizes corresponding data driving signals to charge a subpixel with a most prior charging order with a longest charging period in the same frame. In detail, the prior art charges subpixels with a ratio Ratio_1, and the exemplary embodiment charges subpixels with a ratio Ratio_2 or Ratio_3. The prior art charges subpixels with the ratio Ratio_1, i.e. each subpixel R, G, or B is charged with the same charging period in the horizontal synchronization cycle Hsync_C1. In comparison, the exemplary embodiment charges subpixels with a ratio Ratio_2 or Ratio_3, i.e. the red subpixel R is charged with a charging period longer than that of the subpixel G or B in the horizontal synchronization cycle Hsync_C1, whereas the green subpixel G is charged with a charging period the same with that of the blue subpixel B when the exemplary embodiment charges subpixels with a ratio Ratio_3. As a result, by increasing the charging period for the red subpixel R and decreasing the charging periods for the green subpixel G and the blue subpixel B, the present invention can solve the problem that the red subpixel R is charged less sufficiently, to prevent light and dark lines and color inequality due to charging inequality among subpixels.

Figure 7:
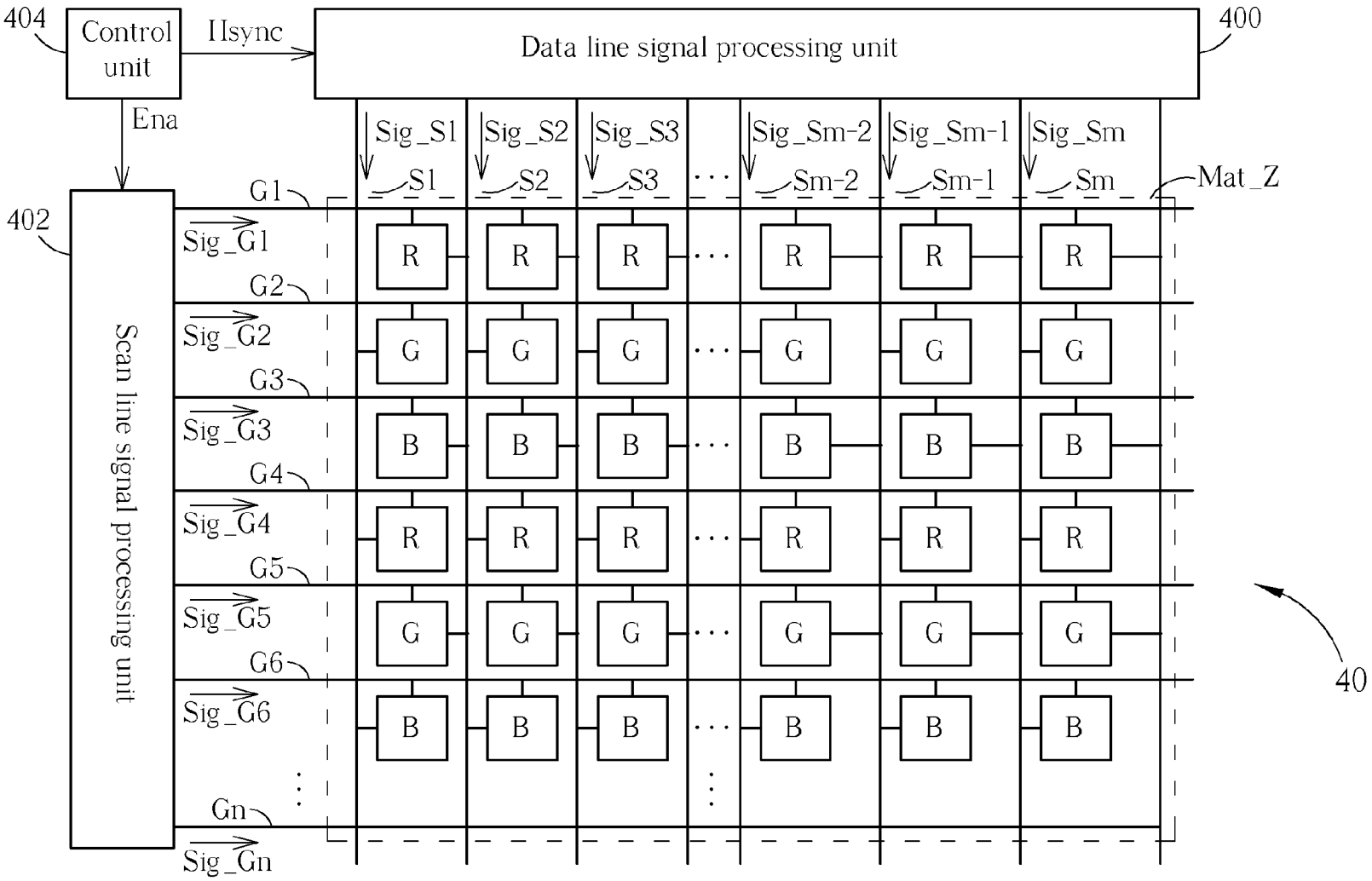
FIG. 7 is a schematic diagram of the present invention applied in an LCD device with a zigzag tri-gate pixel structure in the prior art.

Noticeably, the above description is only an embodiment of the present invention. The spirit of the present invention is to charge subpixels corresponding to the same data line with different charging orders in different frames, such that each subpixel is charged less sufficiently in turn, or to charge subpixels corresponding to the same data line and the same horizontal synchronization cycle with different charging periods in the same frame, such that the subpixel with the most prior charging order is charged with the longest charging period, to prevent light and dark lines and color inequality due to charging inequality among subpixels. Those skilled in the art may make alterations or modifications according to the concept of the present invention. For example, an arrangement of subpixels is not limited to an arrangement of red subpixel, green subpixel, blue subpixel, and the present invention is not limited to the stripe tri-gate pixel structure, and can be applied to a zigzag tri-gate pixel structure (as shown in FIG. 7, in a pixel matrix Mat_Z, subpixels corresponding to the data lines S1-Sm are interlaced between two subpixel columns), or the dual gate structure. Noticeably, how the scan line signal processing unit 402 outputs the gate driving signals Sig_G1-Sig_Gn and how the data line signal processing unit 400 and the control unit 404 are realized do not affect the scope of the present invention, as long as the subpixels corresponding to the same data line are charged with different charging orders in different frames, or subpixels corresponding to the same data line and the same horizontal synchronization cycle are charged with different charging periods in a same frame, to prevent light and dark lines and color inequality due to charging inequality among subpixels.

Noticeably, the driving module 40 is only utilized for illustrating operations of the present invention, and is not limited to be realized by software or hardware. Those skilled in the art may make proper modifications or adjust conventional driving modules to realize the driving module 40 according to system requirements. For example, if the source driver 100 and the gate driver 102 in FIG. 1 only have a signal amplification function (i.e. the data driving signals Sig_S1-Sig_Sm and the gate driving signals Sig_G1-Sig_Gn sent to the scan lines G1-Gn are generated by the timing controller 104), the function of the driving module 40 can be achieved by modifying a signal output sequence of the timing controller 104, or by modifying internal circuits of the source driver 100 and the gate driver 102 instead of the signal output sequence of the timing controller 104. Otherwise, if the source driver 100 and the gate driver 102 in FIG. 1 have both signal amplification and processing functions (i.e. the timing controller 104 only outputs display data and timing), the function of the driving module 40 can be achieved by modifying signal processing logic of the source driver 100 and the gate driver 102. All of the above description is directed to charging subpixels corresponding to the same data line with different charging orders in different frames, or charging subpixels corresponding to the same data line and the same horizontal synchronization cycle with different charging periods in the same frame.

Figure 8:
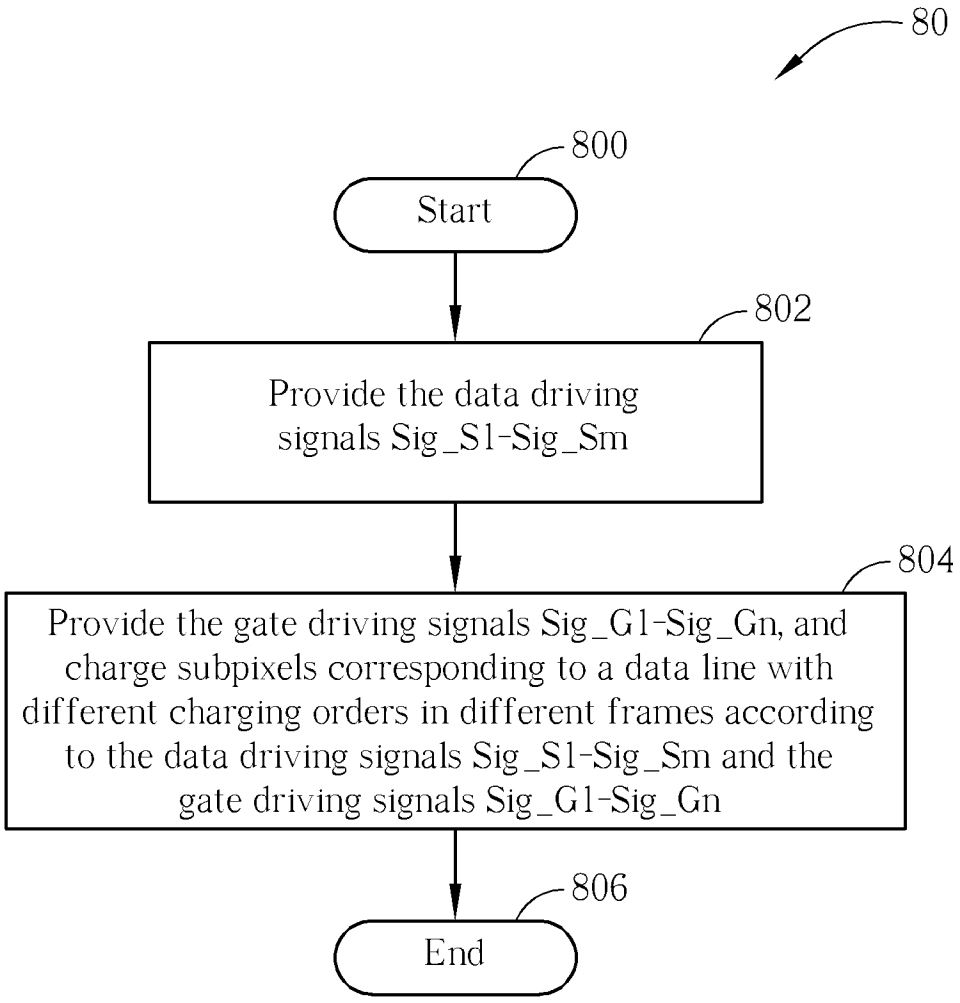
FIG. 8 is a schematic diagram of a driving process according to an embodiment of the present invention.

Operations of the driving module 40 charging subpixels corresponding to the same data line with different charging orders in different frames can be summarized into a driving process 80. As shown in FIG. 8, the driving process 80 includes the following steps:

Step 800: Start.

Step 802: Provide the data driving signals Sig_S1-Sig_Sm.

Step 804: Provide the gate driving signals Sig_G1-Sig_Gn, and charge subpixels corresponding to a data line with different charging orders in different frames according to the data driving signals Sig_S1-Sig_Sm and the gate driving signals Sig_G1-Sig_Gn.

Step 806: End.

Figure 9:
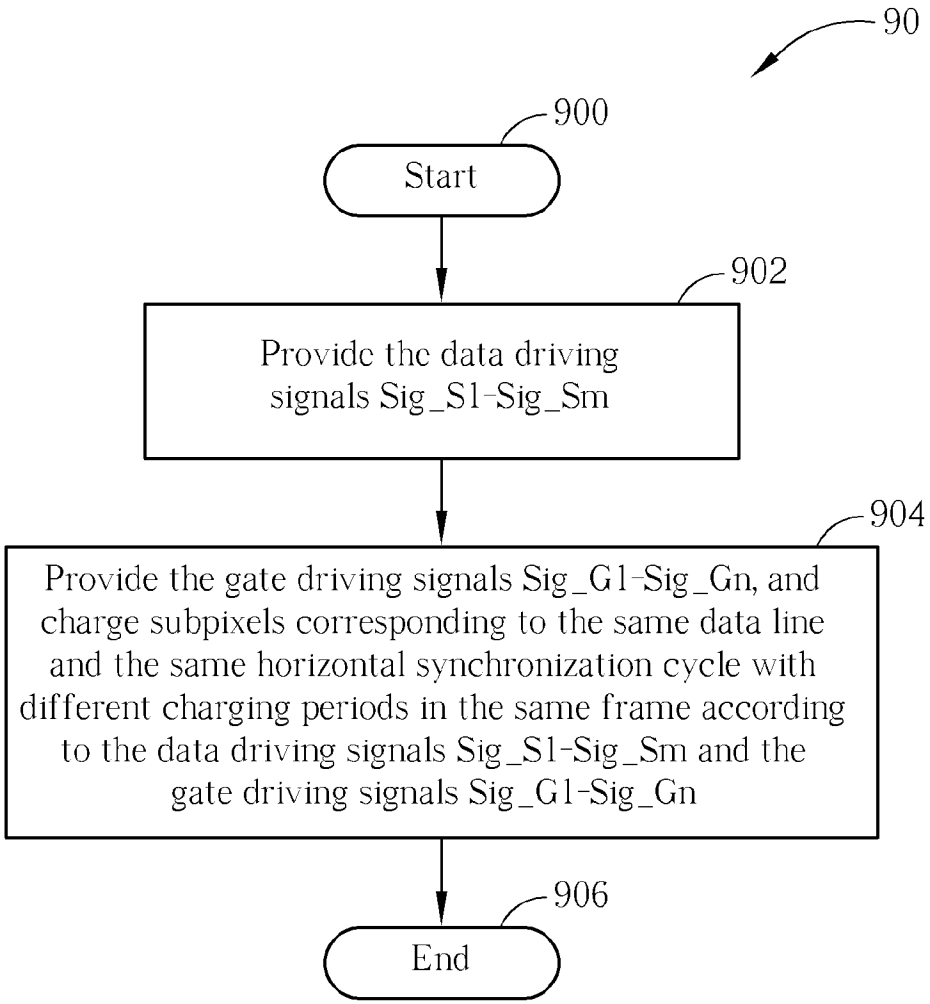
FIG. 9 is a schematic diagram of a driving process according to another embodiment of the present invention.

Operations of the driving module 40 charging subpixels corresponding to the same data line and the same horizontal synchronization cycle with different charging periods in the same frame can be summarized into a driving process 90. As shown in FIG. 9, the driving process 90 includes:

Step 900: Start.

Step 902: Provide the data driving signals Sig_S1-Sig_Sm.

Step 904: Provide the gate driving signals Sig_G1-Sig_Gn, and charge subpixels corresponding to the same data line and the same horizontal synchronization cycle with different charging periods in the same frame according to the data driving signals Sig_S1-Sig_Sm and the gate driving signals Sig_G1-Sig_Gn.

Step 906: End.

For the LCD panel with the tri-gate structure, subpixels are charged with the double gate pulses or the overlap gate pulse in the prior art to avoid charging inequality by increasing pulses, which increase power consumption and inconvenience. In comparison, without increasing pulses, the present invention can charge subpixels corresponding to the same data line with different charging orders in different frames, such that each subpixel is charged less sufficiently in turn, or charge subpixels corresponding to the same data line and the same horizontal synchronization cycle with different charging periods in a same frame, such that the subpixel with the most prior charging order is charged with the longest charging period, to prevent light and dark lines and color inequality due to charging inequality among subpixels.

To sum up, without increasing pulses, the present invention can charge subpixels corresponding to the same data line with different charging orders in different frames, or charge subpixels corresponding to the same data line and the same horizontal synchronization cycle with different charging periods in a same frame, to avoid light and dark lines and color inequality due to charging inequality among subpixels.

Those skilled in the art will readily observe that numerous modifications and alterations of the device and method may be made while retaining the teachings of the invention.

What is claimed is:

1. A driving module for a liquid crystal display (LCD) device, each pixel of the LCD device comprising a plurality of subpixels corresponding to a data line, the driving module comprising:

a data line signal processing unit, for generating a plurality of data driving signals;

a scan line signal processing unit, for generating a plurality of gate driving signals; and a control unit, for controlling the data line signal processing unit and the scan line signal processing unit to charge the plurality of subpixels within a pixel of the LCD device corresponding to the data line with different charging orders in different frames via signal control;

wherein the plurality of subpixels within the pixel are charged during a first frame and a second frame, and the plurality of subpixels within the pixel are not charged in a same sequence during the first frame as the plurality of subpixels within the pixel are charged during the second frame, and the first frame and the second frame are consecutive frames;

wherein the control unit is further utilized for controlling the data line signal processing unit and the scan line signal processing unit, to charge the plurality of subpixels within the pixel corresponding to the data line with reverse charging orders in two adjacent frames, and the plurality of subpixels within the pixel comprises a red (R) subpixel, a green (G) subpixel and a blue (B) subpixel, each set of RGB subpixels of the plurality of subpixels within the pixel is charged with the reverse charging orders in the two adjacent frames and is charged with only one of the reverse charging orders in each frame, and the reverse charging orders are one of RGB/BGR reverse ordering, GRB/BRG reverse ordering and RBG/GBR reverse ordering;

wherein the two reverse charging orders comprise a first forward charging order corresponding to scanning the each set of RGB subpixels within the pixel in only a left to right direction in the entire first frame, and a second reverse charging order corresponding to scanning the each set of RGB subpixels within the pixel in only a right to left direction in the entire second frame.

2. A driving method for a liquid crystal display (LCD) device, each pixel of the LCD device comprising a plurality of subpixels corresponding to a data line, the driving method comprising the steps of:

providing a plurality of data driving signals; and providing a plurality of gate driving signals, and charging the plurality of subpixels within a pixel of the LCD device corresponding to the data line with different charging orders in different frames via signal control according to the plurality of data driving signals and the plurality of gate driving signals; and charging the plurality of subpixels within the pixel corresponding to the data line with two reverse charging orders in two adjacent frames according to the plurality of data driving signals and the plurality of gate driving signals, wherein the plurality of subpixels within the pixel comprises a red (R) subpixel, a green (G) subpixel and a blue (B) subpixel, each set of RGB subpixels of the plurality of subpixels within the pixel is charged with the two reverse charging orders in the two adjacent frames and is charged with only one of the two reverse charging orders in each frame, and the two reverse charging orders are one of RGB/BGR reverse ordering, GRB/BRG reverse ordering and RBG/GBR reverse ordering;

wherein the plurality of subpixels within the pixel are charged during a first frame and a second frame, and the plurality of subpixels within the pixel are not charged in a same sequence during the first frame as the plurality of subpixels within the pixel are charged during the second frame, and the first frame and the second frame are consecutive frames;

wherein the two reverse charging orders comprise a first forward charging order corresponding to scanning the each set of RGB subpixels within the pixel in only a left to right direction in the entire first frame, and a second reverse charging order corresponding to scanning the each set of RGB subpixels within the pixel in only a right to left direction in the entire second frame.

* * * * *